US010555376B2

(12) United States Patent
Kim et al.

(10) Patent No.: US 10,555,376 B2
(45) Date of Patent: Feb. 4, 2020

(54) HEATING PASTE COMPOSITION, AND SHEET HEATING ELEMENT, HEATING ROLLER, HEATING UNIT AND HEATING MODULE USING SAME

(71) Applicant: KOREA ELECTRONICS TECHNOLOGY INSTITUTE, Seongnam-si, Gyeonggi-do (KR)

(72) Inventors: Yoonjin Kim, Suwon-si (KR); Jinwoo Cho, Seongnam-si (KR)

(73) Assignee: Korea Electronics Technology Institute, Gyeonggi-Do (KR)

( * ) Notice: Subject to any disclaimer, the term of this patent is extended or adjusted under 35 U.S.C. 154(b) by 540 days.

(21) Appl. No.: 15/351,347

(22) Filed: Nov. 14, 2016

(65) Prior Publication Data

US 2017/0064774 A1 Mar. 2, 2017

Related U.S. Application Data

(63) Continuation of application No. PCT/KR2015/004662, filed on May 11, 2015.

(30) Foreign Application Priority Data

May 13, 2014 (KR) ..... 10-2014-0056921
May 13, 2014 (KR) ..... 10-2014-0056922

(51) Int. Cl.
*H05B 3/14* (2006.01)
*H01C 17/075* (2006.01)
*H05B 3/46* (2006.01)

(52) U.S. Cl.
CPC ..... *H05B 3/14* (2013.01); *H01C 17/075* (2013.01); *H05B 3/46* (2013.01)

(58) Field of Classification Search
CPC ..... H05B 2203/013; H05B 3/145; H05B 2203/017; H05B 2214/04; H05B 3/262;
(Continued)

(56) References Cited

U.S. PATENT DOCUMENTS 5,828,938 A * 10/1998 Hazama ..... G03G 15/167 399/313
2010/0090171 A1 4/2010 Lee et al.
2013/0200300 A1* 8/2013 Do ..... C09D 133/04 252/75

FOREIGN PATENT DOCUMENTS

JP 3279720 B2 4/2002
JP 2007-272223 A 10/2007
(Continued)

OTHER PUBLICATIONS

International Search Report issued in application No. PCT/KR2015/004662 dated Jul. 13, 2015.

*Primary Examiner* — Ibrahime A Abraham
*Assistant Examiner* — Chris Q Liu
(74) *Attorney, Agent, or Firm* — Knobbe, Martens, Olson & Bear, LLP

(57) ABSTRACT

A heating paste composition, and a sheet heating element, a heating roller, a heating unit and a heating module, which use the composition, are disclosed. In one aspect, the heating paste composition includes 0.2 parts to 6 parts by weight of carbon nanotube particles, 0.5 parts to 30 parts by weight of graphite particles, 5 parts to 30 parts by weight of a binder mixture, 29 parts to 80 parts by weight of an organic solvent and 0.5 parts to 5 parts by weight of a dispersant, wherein the weights are with respect to 100 parts by weight of the heating paste composition.

6 Claims, 10 Drawing Sheets

(58) Field of Classification Search
CPC ..... H05B 3/0095; H05B 3/14; H05B 3/46; H05B 33/04; H05B 3/265; H01C 17/065; H01C 17/0652; H01C 17/06586; H01C 17/06593; H01C 17/075
USPC ..... 219/469, 543, 619, 539, 470, 548, 541, 219/542, 553, 471, 538, 544, 494, 546, 219/547, 552, 666, 478, 482, 483, 486, 219/497, 521, 528, 530, 534, 535, 536, 219/537, 628, 661
See application file for complete search history.

(56) References Cited

FOREIGN PATENT DOCUMENTS

| | | | |
|---|---|---|---|
| KR | 20-0166597 | Y1 | 2/2000 |
| KR | 20-2009-0010252 | U | 10/2009 |
| KR | 10-2010-0040033 | A | 4/2010 |
| KR | 10-2011-0043367 | | 4/2011 |
| KR | 10-1128033 | B1 | 4/2012 |

* cited by examiner

HEATING PASTE COMPOSITION, AND SHEET HEATING ELEMENT, HEATING ROLLER, HEATING UNIT AND HEATING MODULE USING SAME

CROSS-REFERENCE TO RELATED APPLICATIONS

Any and all priority claims identified in the Application Data Sheet, or any correction thereto, are hereby incorporated by reference under 37 CFR 1.57. For example, this application is a continuation application, and claims the benefit under 35 U.S.C. § 120 and § 365 of PCT Application No. PCT/KR2015/004662, filed on May 11, 2015, which is hereby incorporated by reference. PCT/KR2015/004662 also claimed priority from Korean Patent Application No. 10-2014-0056921 filed on May 13, 2014 and Korean Patent Application No. 10-2014-0056922 filed on May 13, 2014, each of which is hereby incorporated by reference.

BACKGROUND

Field

The described technology generally relates to a heating paste composition exhibiting high energy efficiency, and a sheet heating element, a heating roller, a heating unit and a heating module, which use the composition.

Description of the Related Art

A heating roller or heating unit is a part needed for thermal fusing of a toner on printing paper, which is used in an image-forming device (hereinafter, referred to as a printer) such as a printer, a copy machine, or a multifunctional printer. Such a heating roller consumes most of the printer power.

Particularly, a heating roller or heating unit for a laser printer is indirectly heated through radiation using a halogen lamp and thus becomes the main cause of power consumption. This is because radiant heat cannot be completely transferred to a surface of the heating roller, and heat loss occurs at both ends of the heating roller or heating unit.

Also, such a heat transfer system takes a long time for warm-up when the power of the printer is on, and takes a long time to remove heat when the power of the printer is off, resulting in power consumption.

SUMMARY

One inventive aspect relates to a highly efficient heating material capable of replacing a conventional halogen lamp, a heating roller and a heating unit.

Another aspect is a heating paste composition, which has high heat resistance and thus is less changed in resistance according to temperature and capable of being driven at low voltage and low power, and a sheet heating element, a heating roller, a heating unit and a heating module, which use the composition.

In one embodiment, the heating paste composition includes 0.2 to 6 parts by weight of carbon nanotube particles, 0.5 to 30 parts by weight of graphite particles, 5 to 30 parts by weight of a binder mixture, 29 to 80 parts by weight of an organic solvent, and 0.5 to 5 parts by weight of a dispersant with respect to 100 parts by weight of the heating paste composition.

In another embodiment, the heating paste composition further includes 0.5 to 5 parts by weight of a silane additive with respect to 100 parts by weight of the heating paste composition.

In another embodiment of the heating paste composition, the binder mixture is prepared by mixing 10 to 150 parts by weight of a polyvinyl acetal resin and 100 to 500 parts by weight of a phenol resin with respect to 100 parts by weight of epoxy acrylate or hexamethylene diisocyanate.

In another embodiment of the heating paste composition, the carbon nanotube particles include multi-walled carbon nanotube particles.

In another embodiment of the heating paste composition, the organic solvent includes a solvent mixture consisting of two or more selected from carbitol acetate, butyl carbitol acetate, dibasic ester (DBE), ethyl carbitol, ethyl carbitol acetate, dipropylene glycol methylether, cellosolve acetate, butyl cellosolve acetate, butanol and octanol.

In another embodiment the sheet heating element using the heating paste composition includes 0.2 to 6 parts by weight of carbon nanotube particles, 0.5 to 30 parts by weight of graphite particles, 5 to 30 parts by weight of a binder mixture, 29 to 80 parts by weight of an organic solvent, and 0.5 to 5 parts by weight of a dispersant with respect to 100 parts by weight of the heating paste composition through screen printing, gravure printing or comma coating.

In another embodiment the heating roller using the heating paste composition includes a roller, an insulating layer formed on a circumferential surface of the roller, a sheet heating element formed of the heating paste composition including 0.2 to 6 parts by weight of carbon nanotube particles, 0.5 to 30 parts by weight of graphite particles, 5 to 30 parts by weight of a binder mixture, 29 to 80 parts by weight of an organic solvent and 0.5 to 5 parts by weight of a dispersant with respect to 100 parts by weight of the heating paste composition and formed on the circumferential surface of the roller, and an electrode installed at both ends of the sheet heating element to supply power to the heating element.

In another embodiment, the heating roller using the heating paste composition further includes a Teflon release layer formed on a circumferential surface of the sheet heating element.

In another embodiment, the heating unit using the heating paste composition includes a substrate, a protective layer formed on one surface of the substrate, a sheet heating element formed of the heating paste composition, which includes 0.2 to 6 parts by weight of carbon nanotube particles, 0.5 to 30 parts by weight of graphite particles, 5 to 30 parts by weight of a binder mixture, 29 to 80 parts by weight of an organic solvent, 0.5 to 5 parts by weight of a dispersant with respect to 100 parts by weight of the heating paste composition and formed on one surface of the protective layer, which is opposite to the substrate, electrodes installed at both ends of the sheet heating element to supply power, and a polyimide sheet formed on one surface of the sheet heating element, which is opposite to the protective layer.

In another embodiment, the heating unit using the heating paste composition includes a substrate wherein, the substrate consists of copper, aluminum or stainless steel.

In another embodiment, the heating unit using the heating paste composition includes a protective layer wherein, the protective layer includes silica ($SiO_2$).

In another embodiment, in the heating unit using the heating paste composition, the sheet heating element is formed of the heating paste composition on the protective layer or polyimide sheet through screen printing, gravure printing or comma coating.

In another embodiment, the heating unit using the heating paste composition further includes a Teflon release layer formed on one surface of the substrate, which is opposite to the protective layer.

In another embodiment, the heating module using the heating paste composition includes a heating unit, which includes a substrate, a protective layer formed on one surface of the substrate, a sheet heating element formed of the heating paste composition including 0.2 to 6 parts by weight of carbon nanotube particles, 0.5 to 30 parts by weight of graphite particles, 5 to 30 parts by weight of a binder mixture, 29 to 80 parts by weight of an organic solvent and 0.5 to 5 parts by weight of a dispersant with respect to 100 parts by weight of the heating paste composition and formed on one surface of the protective layer opposite to the substrate, electrodes installed at both ends of the sheet heating element to supply power, and a polyimide sheet formed on one surface of the sheet heating element opposite to the protective layer, and a fixing film having an opening area in a cylindrical lengthwise direction and fixing the heating unit to the opening area.

In another embodiment, in the heating module using the heating paste composition, the heating unit has a form in which stacking the substrate, the protective layer, the sheet heating element, the electrode and the polyimide sheet are stacked in parallel, and is bound to the opening area.

In another embodiment, in the heating module using the heating paste composition, the heating unit has a form in which the substrate, the protective layer, the sheet heating element, the electrode and the polyimide sheet are stacked in parallel, and is bound to the opening area while both sides of the heating unit are bent along a lengthwise direction of the fixing film.

Another aspect is a sheet heating element structure, comprising: a base structure; and a heating paste composition integrated into the base structure, wherein the heating paste composition comprises carbon nanotube particles, graphite particles, a binder mixture, an organic solvent, and a dispersant.

In the above sheet heating element structure, the base structure comprises a protective layer or an electrolyte. In the above sheet heating element structure, the heating paste composition comprises: 0.2 parts to 6 parts by weight of the carbon nanotube particles; 0.5 parts to 30 parts by weight of the graphite particles; 5 parts to 30 parts by weight of the binder mixture; 29 parts to 80 parts by weight of the organic solvent; and 0.5 parts to 5 parts by weight of the dispersant, wherein the weights are with respect to 100 parts by weight of the heating paste composition.

Another aspect is a method of making a sheet heating element structure, comprising: providing a base structure; and integrating a heating paste composition into the base structure, wherein the heating paste composition comprises carbon nanotube particles, graphite particles, a binder mixture, an organic solvent, and a dispersant.

In the above method, the integrating comprises screen printing, gravure printing or comma coating of the heating paste composition into the base structure. In the above method, the heating paste composition comprises: 0.2 parts to 6 parts by weight of the carbon nanotube particles; 0.5 parts to 30 parts by weight of the graphite particles; 5 parts to 30 parts by weight of the binder mixture; 29 parts to 80 parts by weight of the organic solvent; and 0.5 parts to 5 parts by weight of the dispersant, wherein the weights are with respect to 100 parts by weight of the heating paste composition.

Certain Advantageous Effects

In some embodiments, the heating paste composition can maintain heat resistance at a temperature of 200° C. or higher and thus is less changed in resistance according to temperature, and therefore the composition is stable.

In addition, a sheet heating element using such a heating paste composition has a low specific resistance and facilitates a thickness adjustment, thereby performing high temperature heating at low voltage and low power, and thus a heating roller, a heating unit and a heating module including the corresponding heating unit, which have improved energy efficiency, can be manufactured.

As a result in comparison to a conventional halogen lamp, manufacturing costs can be reduced, a printing speed can be enhanced due to a reduced warm-up time, and power consumption can be dramatically reduced by driving the heating roller using a low direct current driving voltage.

DETAILED DESCRIPTION

Figure 1:
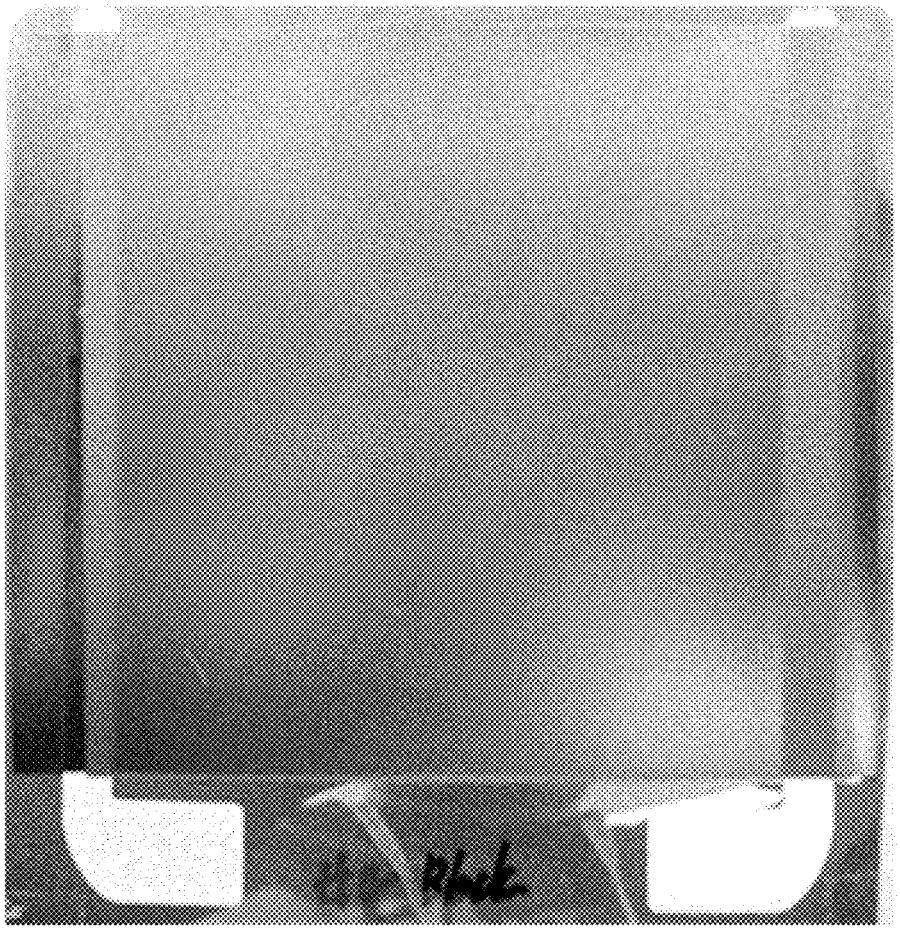
FIG. 1 illustrates a specimen of a sheet heating element manufactured using a heating paste composition according to an embodiment.

A typical sheet heating element using carbon processes a paste prepared by dispersing carbon-based powder such as carbon black in a proper form. The sheet heating element is driven while the temperature of a material is maintained at a desired level by supplying a current to both ends of the sheet heating element. However, such a carbon-black based carbon sheet heating element cannot be used to develop a heating element having heat resistance at 200° C. or higher due to a characteristic positive coefficient temperature (PCT) of the carbon-black. Additionally, due to a relatively high specific resistance of the composition and a difficult thick film process, it is difficult for the heating roller or heating unit including the heating element to be driven at low voltage and low power, and time for continuous operation is also short.

The present disclosure relates to a heating paste composition, and a sheet heating element and a heating roller, which include the corresponding composition. Hereinafter, embodiments of the present disclosure will be described in further detail with reference to the accompanying drawings.

In one embodiment, the heating paste composition includes carbon nanotube particles, graphite particles, a binder mixture, an organic solvent and a dispersant.

In one embodiment, the heating paste composition includes 0.2 parts to 6 parts by weight of carbon nanotube particles, 0.5 parts to 30 parts by weight of graphite particles, 5 parts to 30 parts by weight of a binder mixture, 29 parts to 80 parts by weight of an organic solvent, and 0.5 parts to 5 parts by weight of a dispersant with respect to 100 parts by weight of the heating paste composition.

The carbon nanotube particles may be selected from single-walled carbon nanotubes, double-walled carbon nanotubes, multi-walled carbon nanotubes or a mixture thereof. For example, the carbon nanotube particles may be multi-walled carbon nanotubes. When the carbon nanotube particles are multi-walled carbon nanotubes, the particle may have a diameter of 5 nm to 30 nm and a length of 3 μm to 40 μm.

The graphite particles may have a diameter of 1 μm to 25 μm.

The binder mixture allows the heating paste composition to have heat resistance at a temperature of approximately 300° C., and is a mixture of two or more selected from polyester, epoxy, epoxy acrylate, hexamethylene diisocyanate, polyvinyl acetal and a phenol resin. The binder mixture may be a mixture of polyester, polyvinyl acetal and a phenol resin, a mixture of epoxy, polyvinyl acetal and a phenol resin, or a mixture of epoxy acrylate, polyvinyl acetal and a phenol resin, or a mixture of hexamethylene diisocyanate, polyvinyl acetal and a phenol resin. In some embodiments, as the heat resistance of the binder mixture increases, there is no change in resistance of the material or no damage to a coated film even when the composition is heated to a high temperature of approximately 300° C.

Here, the phenol resin refers to a phenolic compound including phenol and phenol derivatives. For example, the phenol derivatives include p-cresol, o-guaiacol, creosol, catechol, 3-methoxy-1,2-benzenediol, homocatechol, vinylguaiacol, syringol, iso-eugenol, methoxyeugenol, o-cresol, 3-methyl-1,2-benzenediol, (z)-2-methoxy-4-(1-propenyl)-phenol, 2,6-dimethoxy-4-(2-propenyl)-phenol, 3,4-dimethoxy-phenol, 4-ethyl-1,3-benzenediol, resole phenol, 4-methyl-1,2-benzenediol, 1,2,4-benzenetriol, 2-methoxy-6-methylphenol, 2-methoxy-4-vinylphenol, and 4-ethyl-2-methoxy-phenol, but the described technology is not limited thereto.

The mixing ratio of the binder mixture may be 10 parts to 150 parts by weight of a polyvinyl acetal resin and 100 parts to 500 parts by weight of a phenol resin with respect to 100 parts by weight of polyester, epoxy, epoxy acrylate or hexamethylene diisocyanate. In some embodiments, when the content of the phenol resin is 100 parts by weight or less, heat resistance of the heating paste composition is degraded, and when the content of the phenol resin is more than 500 parts by weight, flexibility is degraded (increased brittleness).

In some embodiments, the organic solvent is used to disperse conductive particles and the binder mixture, and may be a solvent mixture of two or more selected from carbitol acetate, butyl carbitol acetate, dibasic ester (DBE), ethyl carbitol, ethyl carbitol acetate, dipropylene glycol methylether, cellosolve acetate, butyl cellosolve acetate, butanol and octanol.

Meanwhile, for a process of dispersion, a variety of generally used methods such as ultra-sonication, roll milling, bead milling or ball milling may be applied.

In some embodiments, the dispersant is used to further facilitate dispersion, and may be a general dispersant, for example, BYK types, an amphoteric surfactant such as Triton X-100, or an ionic surfactant such as SDS.

The heating paste composition may further include 0.5 parts to 5 parts by weight of a silane coupling agent with respect to 100 parts by weight of the heating paste composition.

In some embodiments, the silane coupling agent serves as an adhesion promoter to improve adhesion strength between resins when the components of the heating paste composition are mixed. The silane coupling agent may be an epoxy-containing silane or a mercapto-containing silane. Examples of the silane coupling agents include epoxy-containing silanes such as 2-(3,4 epoxy cyclohexyl)-ethyltrimethoxysilane, 3-glycidoxytrimethoxysilane, and 3-glycidoxypropyltriethoxysilane, amine-containing silanes such as N-2(aminoethyl)3-aminopropylmethyldimethoxysilane, N-2(aminoethyl)3-aminopropyltrimethoxysilane, N-2(aminoethyl)3-aminopropyltriethoxysilane, 3-aminopropyltrimethoxysilane, 3-aminopropyltriethoxysilane, 3-triethoxysilyl-N-(1,3-dimethylbutylidene)propylamine and N-phenyl-3-aminopropyltrimethoxysilane, mercapto-containing silanes such as 3-mercaptopropylmethyldimethoxysilane and 3-mercaptopropyltriethoxysilane, and an isocyanate-containing silane such as 3-isocyanatepropyltrimethoxysilane, but the described technology is not limited thereto.

Some embodiments provide a sheet heating element including the heating paste composition formed on a substrate or the circumferential surface of a roller by screen printing, gravure printing (or roll-to-roll gravure printing) or comma coating (or roll-to-roll comma coating).

The substrate may be polycarbonate, polyethyleneterephthalate (PET), polyethylenenaphthalate (PEN), polyimide, cellulose ester, nylon, polypropylene, polyacrylonitrile, polysulfone, polyestersulfone, polyvinylidenefluoride, glass, glass fiber (matt), ceramic, SUS, a copper or aluminum substrate, but the described technology is not limited thereto. For example, the substrate can be suitably selected according to an application or a temperature at which the heating element is used.

The sheet heating element may be formed by printing the heating paste composition on the substrate through screen printing or gravure printing in a desired pattern, and forming an electrode by printing and drying/curing a silver paste or conductive paste thereon. The sheet heating element may also be formed by printing and drying/curing a silver paste or a conductive paste, and screen printing or gravure printing the heating paste composition.

The sheet heating element may further include a protective layer formed to coat a top surface thereof. In some embodiments, the protective layer is formed of silica ($SiO_2$). In some embodiments, the flexibility of a heating element can be maintained even though a heating surface is coated when a protective layer is formed of resins including silica.

Hereinafter, the heating paste composition and the sheet heating element using the same will be described in detail with reference to experimental examples. The following experimental examples are merely provided to illustrate the present embodiments, and described technology is not limited to the following experimental examples.

Experimental Examples (1) Preparation of Examples and Comparative Examples

Examples (3 types) and comparative examples (3 types) were prepared as shown in Table 1. Composition ratios shown in Table 1 are given as wt %.

TABLE 1

| Composition | Example 1 | Example 2 | Example 3 | Comparative Example 1 | Comparative Example 2 | Comparative Example 3 |
|---|---|---|---|---|---|---|
| Carbon nanotube particles | 4 | 5 | 6 | 4 | 4 | 5 |
| Graphite particles | 15 | 9 | 15 | | | |
| Carbon black particles | | | | 15 | 15 | 9 |
| Binder mixture | 20 | 15 | 22 | | 12 | |
| Ethyl cellulose | | | | 10 | | 14 |
| Organic solvent | 57 | 66 | 54 | 67 | 65 | 68 |
| Dispersant | 4 | 4 | 5 | 4 | 4 | 4 |

In the case of the examples, a heating paste was prepared by predispersing carbon nanotube particles, graphite particles, a binder mixture, an organic solvent and a dispersant using a predispersion instrument for 1 hour according to the compositions shown in Table 1 (Examples 1 to 3), and completely stirring a predispersed paste using a 3-roll mill. Subsequently, the heating paste was aged at room temperature for 12 hours, and then printed using a 325 mesh screen, thereby manufacturing a heating element.

In the case of the comparative examples, according to the compositions shown in Table 1 (Comparative Examples 1 to 3), a heating paste was prepared by predispersing carbon nanotube particles, carbon black particles, a binder mixture or ethyl cellulose, an organic solvent and a dispersant using a predispersion instrument for 1 hour, and completely stirring a predispersed paste using a 3-roll mill. The heating paste was aged at room temperature for 12 hours, and then printed using a 325 mesh screen, thereby manufacturing a heating element.

(2) Evaluation of Properties of Sheet Heating Element

Figure 2:
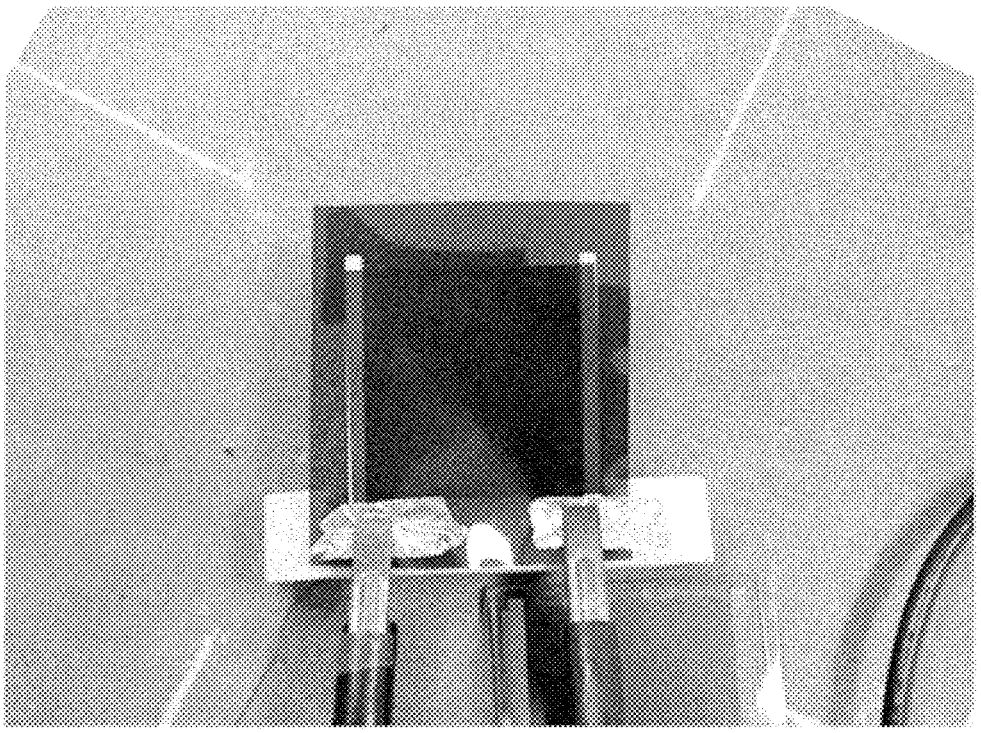
FIG. 2 illustrates a heating test for the sheet heating element according to an embodiment of FIG. 1.
Figure 3:
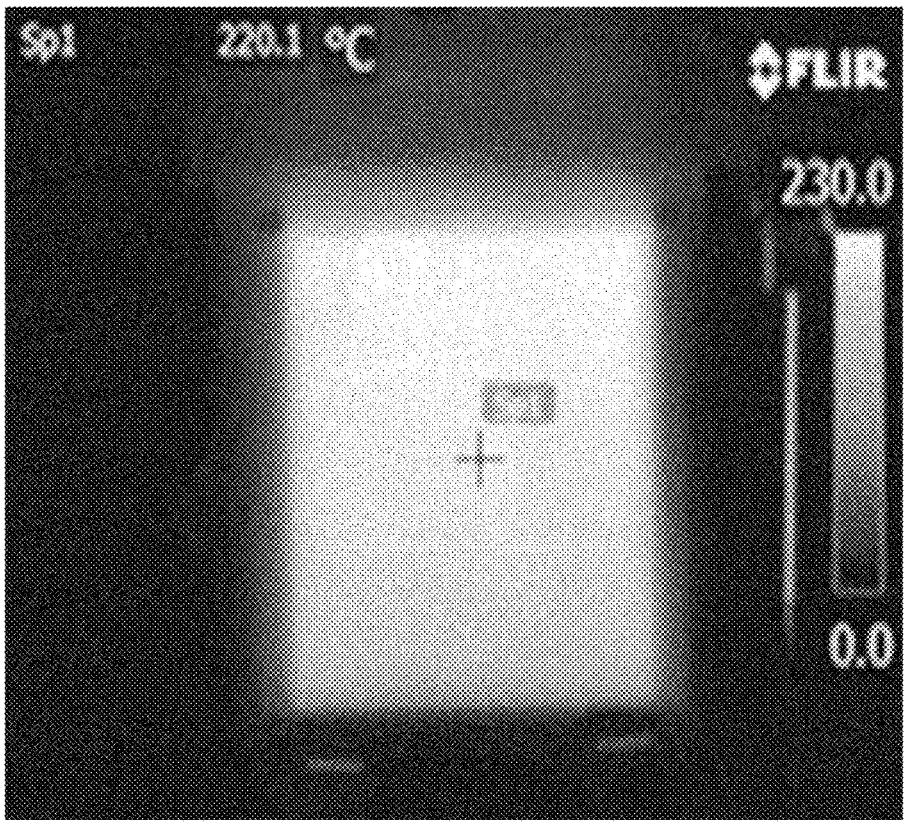
FIG. 3 illustrates the sheet heating element according to the embodiment of FIG. 1, taken by a thermographic camera.

FIG. 1 illustrates a specimen of a sheet heating element manufactured using a heating paste composition, FIG. 2 illustrates a heating test for the sheet heating element according to the embodiment of FIG. 1, and FIG. 3 illustrates the sheet heating element according to the embodiment of FIG. 1, taken by a thermographic camera.

1) Evaluation of Specific Resistance

As shown in FIG. 1, a composition was cured after screen printing in a size of 10 cm×10 cm, a linear resistance between both ends was determined, and a thickness of a printed electrode was measured through SEM, thereby calculating a specific resistance.

2) Evaluation of Properties of Composition For Sheet Heating Element

As shown in FIG. 1, a composition was cured after screen printing in a size of 10 cm×10 cm, thereby constituting a heating element, as shown in FIG. 2, an electrode material was printed on both ends of the heating element to manufacture a sample for a heating test, and as shown in FIG. 3, temperature uniformity of each part of the heating element was measured using a thermographic camera while an electrode voltage was applied.

Here, to confirm a temperature-increasing effect according to power supplied, a sheet heating element corresponding to each example or comparative example is increased in temperature up to 150° C., 180° C., or 220° C., and a DC power when the sheet heating element reached the corresponding temperature was measured.

In addition, heating stability was tested for each example and comparative examples at 200° C.

Test results are shown in Table 2 below.

TABLE 2

| Property | Example 1 | Example 2 | Example 3 | Comparative Example 1 | Comparative Example 2 | Comparative Example 3 |
|---|---|---|---|---|---|---|
| Specific resistance ($10^{-2}$ Ωcm) | 1.9 | 2.55 | 2.96 | 49.3 | 60.5 | 59.3 |
| DC power (w) required to reach 150° C. | 22.3 | 24.5 | 25.6 | 127.3 | 136.5 | 132.9 |
| DC power (w) required to reach 180° C. | 30.8 | 33.0 | 36.5 | 146.5 | 172.3 | 168.5 |
| DC power (w) required to reach 220° C. | 44.0 | 47.5 | 48.6 | 162.5 | 200.3 | 185.6 |
| Heating stability (day) | 20 days or longer | 20 days or longer | 20 days or longer | Fail | 5 days | Fail |

Referring to Table 2, the measured specific resistance of the sheet heating element corresponding to each example was smaller than that corresponding to each comparative example. Also, the measured DC power required to heat the sheet heating element up to 150° C., 180° C. or 220° C. was also lower than those of comparative examples. That is, it can be confirmed that the sheet heating elements of the examples have lower power consumption and improved heating performance than those of the comparative examples.

Also, the sheet heating elements according to Examples 1 to 3, maintained stability for 20 days while being driven even at 200° C. (without a separate protective layer). However, in Comparative Examples 1 to 3, swelling of a heating surface is observed within 2 hours or a maximum of 5 days after the sheet heating elements are driven at 200° C. Therefore, it can be confirmed that the sheet heating elements of the examples are driven more stably even at high temperatures of 200° C. or higher than those of the comparative examples.

Figure 4:
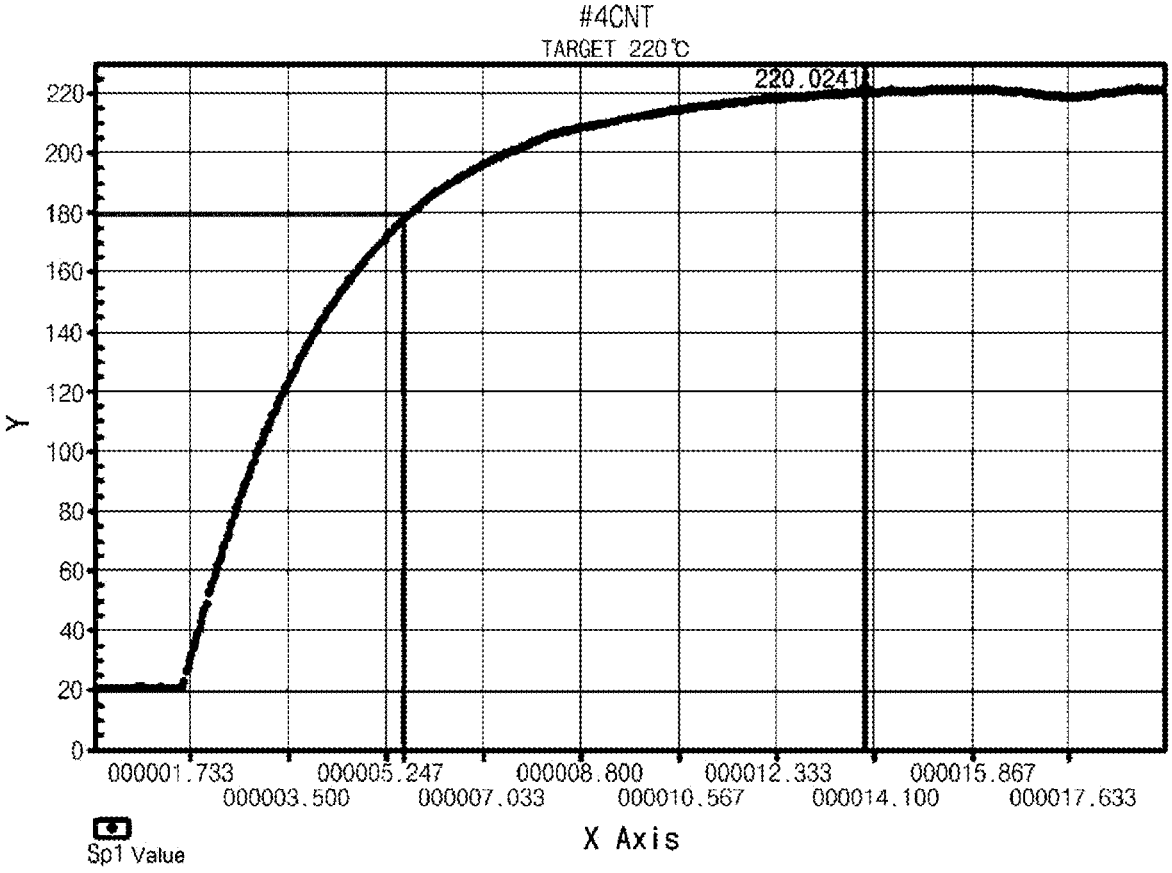
FIG. 4 illustrates a heating property of the sheet heating element according to the embodiment of FIG. 1.

FIG. 4 illustrates a heating property of the sheet heating element according to the embodiment of FIG. 1.

In FIG. 4, the y-axis represents heating temperature and the x-axis represents time, which shows heating behavior when 31.5V DC was applied to the sheet heating element of the examples.

In FIG. 4, it can be confirmed that the time for reaching 180° C. is only 6 seconds or less, which demonstrates that fast warm-up and an improved printing speed can be achieved by short temperature-increasing time.

The sheet heating element of the examples may reach 180° C. within 12 seconds even when the sheet heating element is coated with a protective film or a release layer such as Teflon.

The described technology further provides a heating roller employing a sheet heating element consisting of the above-described heating paste composition.

Figure 5:
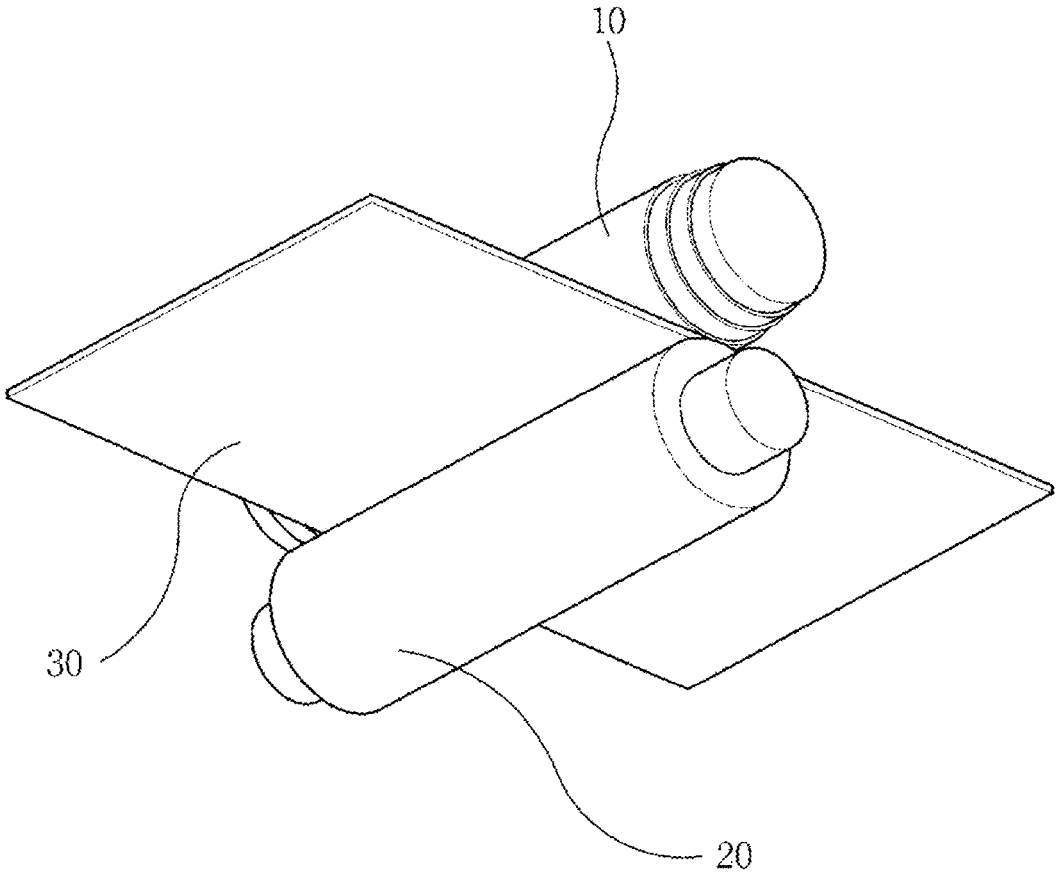
FIG. 5 illustrates driving of a heating roller according to one exemplary embodiment.
Figure 6:
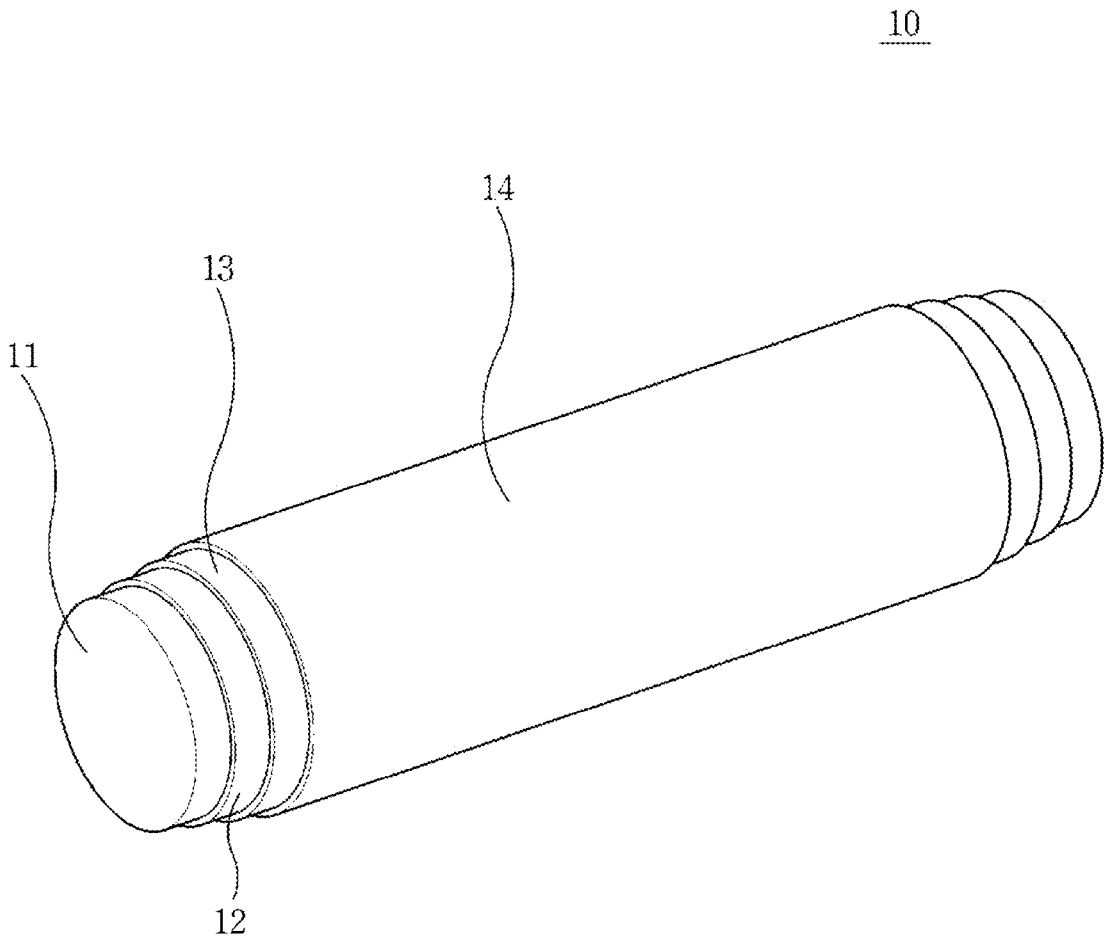
FIG. 6 illustrates the heating roller according to another embodiment.
Figure 7:
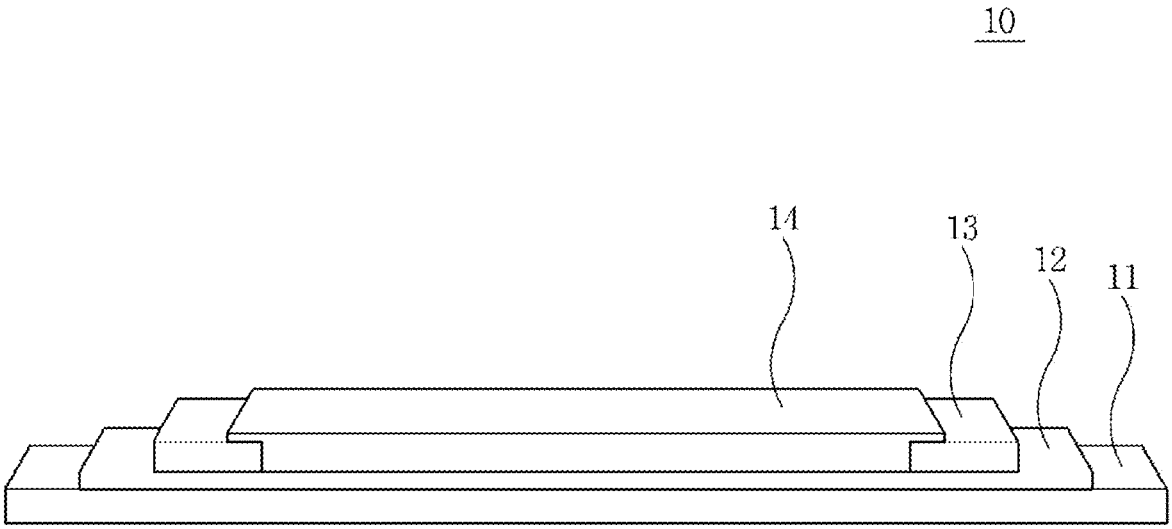
FIG. 7 illustrates components of the heating roller according to another embodiment.

FIG. 5 illustrates driving of a heating roller 10 according to one embodiment, FIG. 6 illustrates the heating roller 10 according to one embodiment, and FIG. 7 illustrates components of the heating roller 10 according to one embodiment.

Referring to FIGS. 5 to 7, an image-forming device such as a printer fuses a toner image to paper 30 using a heating roller 10 and a press roller 20, which are installed at a paper discharging unit.

Here, the heating roller 10 may transfer heat to the paper 30 passing between the heating roller 10 and the press roller 20, and the press roller 20 includes an elastic material such as rubber and thus may transfer a suitable pressure to the paper 30 between the heating roller 10 and the press roller 20. Therefore, the toner image transferred to the paper 30 may be fixed using heat and pressure.

The heating roller 10 includes a roller 11, an insulating layer 12, an electrode 13 and a sheet heating element 14.

The roller 11 can be a cylindrical rotating body, which is rotating about an axis of rotation.

The insulating layer 12 may be formed of a glass powder paste such as a glass frit, and is formed on the circumferential surface of the roller 11 and positioned between the roller 11 and the sheet heating element 14.

The sheet heating element 14 includes the above-described heating paste composition, which may include 0.2 parts to 6 parts by weight of carbon nanotube particles, 0.5 parts to 30 parts by weight of graphite particles, 5 parts to 30 parts by weight of a binder mixture, 29 parts to 80 parts by weight of an organic solvent, and 0.5 parts to 5 parts by weight of a dispersant with respect to 100 parts by weight of the heating paste composition. The sheet heating element 14 is formed on the circumferential surface of the insulating layer 12.

The electrode 13 is installed at both ends of the sheet heating element 14 to provide power to the sheet heating element. The electrode 13 may include a lead electrode formed on the right and left sides of the sheet heating element 14 by coating, and electrodes for power connection, which are formed to be attached to the corresponding lead electrode. In some cases, the electrodes for power connection may be directly connected to the sheet heating element. The electrode 13 may be formed with a silver paste, a copper paste, or a copper tape.

A Teflon release layer may be formed for preventing the toner from adhering to the circumferential surface of the sheet heating element 14. Here, the Teflon release layer may be formed by powder coating or spray coating.

The present disclosure further provides a heating unit employing a sheet heating element including the above-described heating paste composition and a heating module using the corresponding heating unit.

Figure 8:
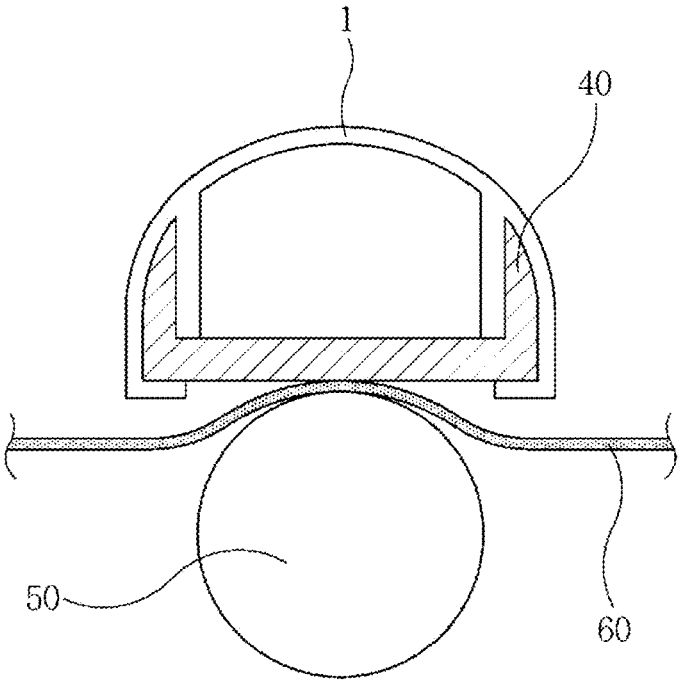
FIG. 8 illustrates driving of a heating module according to one exemplary embodiment.
Figure 9:
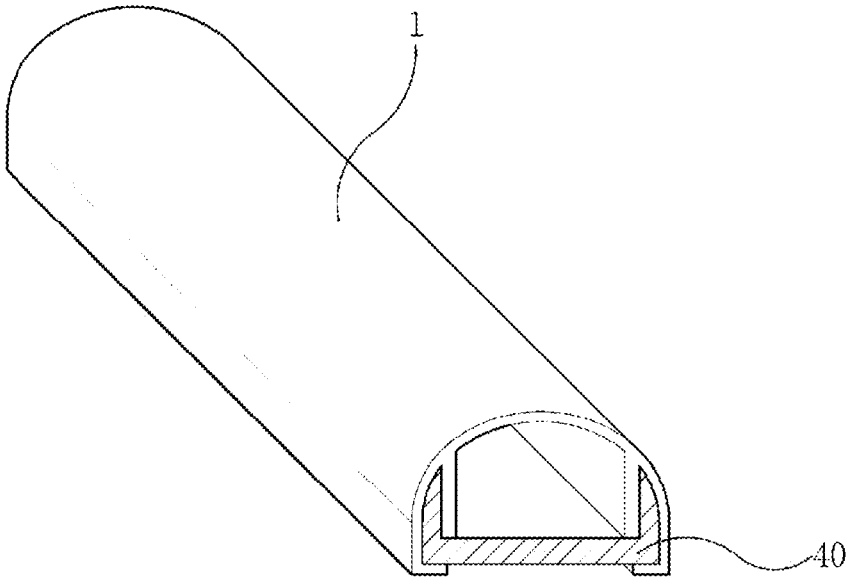
FIG. 9 illustrates the heating module according to another embodiment.
Figure 10:
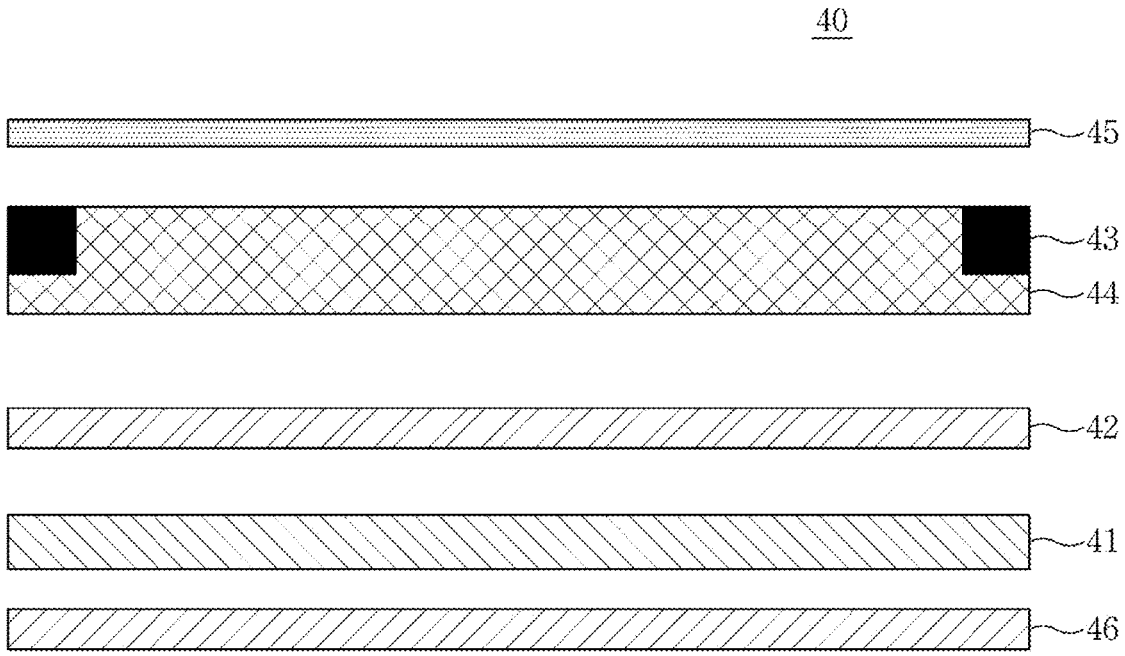
FIG. 10 illustrates components of a heating unit according to one exemplary embodiment.

FIG. 8 illustrates driving a heating module according to one embodiment, FIG. 9 illustrates the heating module according to one embodiment, and FIG. 10 illustrates components of a heating unit 40 according to one embodiment.

Referring to FIGS. 8 to 10, an image-forming device such as a printer fuses a toner image to paper 60 using a heating unit 40 and a press roller 50, which is installed at a paper discharging unit.

In some embodiments, the heating unit 40 transfers heat to the paper 60 passing between the heating unit 40 and the press roller 50. The press roller 50 can include an elastic material such as rubber and thus may transfer a suitable pressure to the paper 60 between the heating roller 40 and the press roller 60. Therefore, the toner image transferred to the paper 60 may be fixed using heat and pressure.

The heating unit 40 constitutes a heating module along with a fixing film 1. The fixing film 1 is a component for fixing the heating unit 40, and can form a cylindrical shape having one flat side with the heating unit 40. Here, the fixing film 1 may have an opening area in a cylindrical lengthwise direction, and may allow the heating unit 40 to be fixed to the opening area of the fixing film 1.

The heating unit 40 may have a structure in which a substrate 41, a protective layer 42, an electrode 43, a sheet heating element 44, a polyimide sheet 45 and a Teflon release layer 46 are stacked. Here, the heating unit 40 in a parallel-stacked form may be bound to the opening area of the fixing film 1, and as shown in FIGS. 8 and 9. For example, the heating unit 40 is bound to the opening area of the fixing film 1 while edges of the heating unit 40 are bent along the lengthwise direction of the fixing film 1 in a "⊏" shape.

The substrate 41 can have a planar structure made of a metal, such as copper, aluminum or stainless steel.

The protective layer 42 is formed on one surface of the substrate 41 and positioned between the substrate 41 and the sheet heating element 44. The protective layer 42 is formed to enhance voltage resistance and heat resistance, and may include a silica ($SiO_2$)-based thermosetting resin, and even maintain flexibility when being formed to coat the sheet heating element 44.

The sheet heating element 44 includes the above-described heating paste composition, which may include 0.2 parts to 6 parts by weight of carbon nanotube particles, 0.5 parts to 30 parts by weight of graphite particles, 5 parts to 30 parts by weight of a binder mixture, 29 parts to 80 parts by weight of an organic solvent, and 0.5 parts to 5 parts by weight of a dispersant. The sheet heating element 44 is formed on one surface of the protective layer 42 opposite to the substrate 41, and positioned between the protective layer 42 and the polyimide sheet 45.

The electrode 43 is installed at both ends of the sheet heating element 44 to provide power to the sheet heating element. The electrode 43 may include lead electrodes formed at right and left sides of the sheet heating element 44 by coating, and electrodes for a power connection, which are bound to the corresponding lead electrodes. In some cases, the electrodes for a power connection may be directly connected to the sheet heating element. The electrode 43 may be formed using a silver paste, a copper paste, or a copper tape.

The polyimide sheet 45 in a film form is formed on one surface of the sheet heating element 44 opposite to the protective layer 42. The polyimide sheet 45 may have excellent mechanical strength, electrical property and heat resistance.

The Teflon release layer 46 is formed on one surface of the substrate 41 opposite to the protective layer 42. The Teflon release layer 46 prevents a toner from adhering to the substrate 41, and may be formed by powder coating or spray coating.

Such a heating unit 40 may be manufactured by coating one surface of the substrate 41 with the Teflon release layer 46, and sequentially forming the protective layer 42, the electrode 43, the sheet heating element 44 and the polyimide sheet 45 from the other surface of the substrate 41.

Also, the heating unit 40 may be manufactured, for example, by sequentially forming the electrode 43, the sheet heating element 44 and the protective layer 42 on one surface of the polyimide sheet 45, and attaching the surface of the protective layer 42 opposite to the sheet heating element 44 to one surface of the substrate 41.

The embodiments disclosed in the specification and the drawings are merely examples, and are not intended to limit the scope of the described technology. It will be apparent to those of ordinary skill in the art that, other than the embodiments disclosed herein, modifications based on the technological scope of the present disclosure may also be implemented. Also, specific terms have been used in the specification and the drawings, but they are merely used in a general sense to facilitate the understanding of the present disclosure, and are not intended to limit the scope of the present disclosure.

What is claimed is:

1. A heating paste composition, comprising:

0.2 parts to 6 parts by weight of carbon nanotube particles;

0.5 parts to 30 parts by weight of graphite particles;

5 parts to 30 parts by weight of a binder mixture;

29 parts to 80 parts by weight of an organic solvent; and 0.5 parts to 5 parts by weight of a dispersant, wherein the weights are with respect to 100 parts by weight of the heating paste composition, wherein the binder mixture includes (i) a polyvinyl acetal resin, (ii) a phenol resin, and (iii) epoxy acrylate or hexamethylene diisocyanate, wherein the weight of the polyvinyl acetal resin with respect to 100 parts by weight of epoxy acrylate or hexamethylene diisocyanate is 10 parts to 150 parts, and wherein the weight of the phenol resin with respect to 100 parts by weight of epoxy acrylate or hexamethylene diisocyanate is 100 parts to 500 parts.

2. The composition of claim 1, further comprising 0.5 parts to 5 parts by weight of a silane additive with respect to 100 parts by weight of the heating paste composition.

3. The composition of claim 1, wherein the carbon nanotube particles comprise multi-walled carbon nanotube particles.

4. The composition of claim 1, wherein the organic solvent comprises a solvent mixture including at least one of the following: carbitol acetate, butyl carbitol acetate, dibasic ester (DBE), ethyl carbitol, ethyl carbitol acetate, dipropylene glycol methylether, cellosolve acetate, butyl cellosolve acetate, butanol and octanol.

5. A sheet heating element comprising a heating paste composition configured to be integrated into a protective layer or an electrode and comprising:

0.2 parts to 6 parts by weight of carbon nanotube particles;

0.5 parts to 30 parts by weight of graphite particles;

5 parts to 30 parts by weight of a binder mixture;

29 parts to 80 parts by weight of an organic solvent; and 0.5 parts to 5 parts by weight of a dispersant, wherein the weights are with respect to 100 parts by weight of the heating paste composition, and wherein the binder mixture comprises a polyvinyl acetal resin, a phenol resin, and hexamethylene diisocyanate, wherein the weight of the polyvinyl acetal resin with respect to 100 parts by weight of hexamethylene diisocyanate is 10 parts to 150 parts, and wherein the weight of the phenol resin with respect to 100 parts by weight of hexamethylene diisocyanate is 100 parts to 500 parts.

6. The sheet heating element of claim 5, wherein the sheet heating element is formed using screen printing, gravure printing or comma coating of the heating paste composition.

* * * * *